US005224305A

United States Patent [19]

Kassai

[11] Patent Number: 5,224,305

[45] Date of Patent: Jul. 6, 1993

[54] SICK ROOM FURNISHED WITH NURSING EQUIPMENT

[76] Inventor: Kenzou Kassai, 14-9, Higashishinsaibashi 1-chome, Chuo-ku, Osaka, Japan

[21] Appl. No.: 840,793

[22] Filed: Feb. 24, 1992

[30] Foreign Application Priority Data

Feb. 25, 1991 [JP] Japan ..... 3-30476

[51] Int. Cl.[5] ..... A47K 3/16

[52] U.S. Cl. ..... 52/34; 52/79.1; 52/67; 5/604; 4/584

[58] Field of Search ..... 52/34, 35, 64, 67, 79.1, 52/79.2, 106, 90, 91; 5/605, 607, 604, 928; 4/585-587, 564, 546

[56] References Cited

U.S. PATENT DOCUMENTS

| | | | |
|---|---|---|---|
| 2,531,687 | 11/1950 | Jones | 52/34 |
| 2,894,794 | 7/1959 | Mays . | |
| 3,833,945 | 9/1974 | Moody | 5/604 |
| 4,765,355 | 8/1988 | Kent . | |
| 4,862,527 | 9/1989 | McAllister | 52/34 |
| 4,910,816 | 3/1990 | Lansing | 5/604 |
| 4,928,329 | 5/1990 | Palmeri | 4/584 |
| 5,054,136 | 10/1991 | Inagaki | 4/546 |

FOREIGN PATENT DOCUMENTS

| | | |
|---|---|---|
| 0155303 | 11/1903 | Fed. Rep. of Germany . |
| 57-148945 | 9/1982 | Japan . |
| 63-309257 | 12/1988 | Japan . |
| 64-42032 | 3/1989 | Japan . |
| 2-215462 | 8/1990 | Japan . |

*Primary Examiner*—Carl D. Friedman
*Assistant Examiner*—Winnie Yip
*Attorney, Agent, or Firm*—W. G. Fasse

[57] ABSTRACT

A sick room preferably in a private home is furnished with nursing equipment in a compact manner. In a room having a 6-mat area corresponding to about 270 cm by 360 cm, a bed apparatus is arranged along a first wall of this room, while a washstand, a washtub and a container box are arranged along a second wall which is adjacent to the first wall. The bed apparatus comprises a lift for carrying an invalid between portions above and on one side of the bed body. A bathtub is stored in a space under the bed body to be drawn out, when needed, into a position along the one side of the bed body. A chamber pot is stored in a space under the washstand. A walking frame is stored in the container box.

5 Claims, 2 Drawing Sheets

SICK ROOM FURNISHED WITH NURSING EQUIPMENT

FIELD OF THE INVENTION

The present invention relates to a sick room which is furnished with equipment for nursing a sick person, a physically handicapped person, a bed-ridden old person or the like, hereinafter referred to as "invalid", and more particularly, it relates to a room furnished with nursing equipment in an ordinary house or home, whereby the available space shall be used in a compact manner.

BACKGROUND INFORMATION

For example, Japanese Patent Laying-Open No. 57-148945 (1982) discloses a lift which is movable along a rail secured to the ceiling of the room. A bed, a washstand, a chamber pot, a bathtub and the like are arranged under or in proximity to the path for the lift along the overhead rail which even leads into a neighboring room. Thus, the apparatus is provided with equipment which are necessary for the daily life of the invalid, so that he can be carried by the rail supported lift to an arbitrary position as needed.

Such a nursing apparatus is suitably installed when it is necessary to carry the invalid between a plurality of rooms, for reducing the burden on the nurse.

In order to install the aforementioned conventional nursing apparatus, however, a relatively large floor space is required. Therefore, it is difficult to directly introduce such a nursing apparatus into an average Japanese house in view of the space required for such an apparatus. Considering housing circumstances in Japan, in particular, a so-called 6-mat room has a dimension of about 270 cm by 360 cm, for example, is normally assigned to an invalid at best.

Thus, it has been substantially impossible to install all required nursing equipment in a relatively narrow, small room, and hence an invalid normally has been left in a bed-ridden state with the exception of a special case. In general, further, it is difficult for a single nurse to move an invalid unaided, and this also leads to a bed-ridden state of the invalid.

However, such a bed-ridden state is rather unpreferable for the invalid to recover from illness or other disorder. In recent years, the importance of rehabilitation has received particular attention, and many reports have been made to the effect that it is rather advisable for an invalid to perform a light exercise, in order to recover sooner.

In view of such circumstances, there is a need of implementing or assembling in a small room all nursing equipment, which can facilitate the movement and rehabilitation of an invalid, who requires medical treatment in his home, who may be left in a bed-ridden state yet without being in a hospital.

SUMMARY OF THE INVENTION

Accordingly, it is an object of the present invention to provide a room furnished with nursing equipments, which room is available in an ordinary house for nursing an invalid in his daily life, and capable of facilitating the rehabilitation of the invalid.

The room furnished with nursing equipment according to the present invention is in the form of a quadrangle. This room is provided with various nursing equipment and equipment for rehabilitation, as follows:

First, a bed apparatus is arranged along a first wall of the quadrangle defining this room. This bed apparatus comprises a bed body for receiving an invalid thereon and a lift for carrying him between portions above and on one side of the bed body.

A washstand, a washtub and a container box are arranged along a second wall, which is adjacent to the aforementioned first wall, of the quadrangle.

A bathtub is stored in a space under the bed body. This bathtub can be drawn out toward the aforementioned one side portion of the bed body.

A chamber pot is stored in a space under the washstand. This chamber pot can be drawn out toward said one side portion of the bed body.

Further, a walking frame is stored in a lower portion of the container box so that the walking frame can be withdrawn for use.

The remaining space of this room may be provided with a dining table, a wagon, a folded wheelchair and the like, if necessary.

Thus, according to the present invention, the bed apparatus comprising the lift is fixedly installed as a main apparatus in the room furnished with nursing equipment. The lift provided on the bed apparatus is moved to carry the invalid between portions above and on one side of the bed body. When the bathtub or the chamber pot is positioned on the side portion of the bed body as needed, therefore, it is possible to bring the invalid to the position of the bathtub or the chamber pot with the lift. The bathtub and the chamber pot can be stored in the spaces under the bed body and the washstand respectively when the same are not used.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 1:
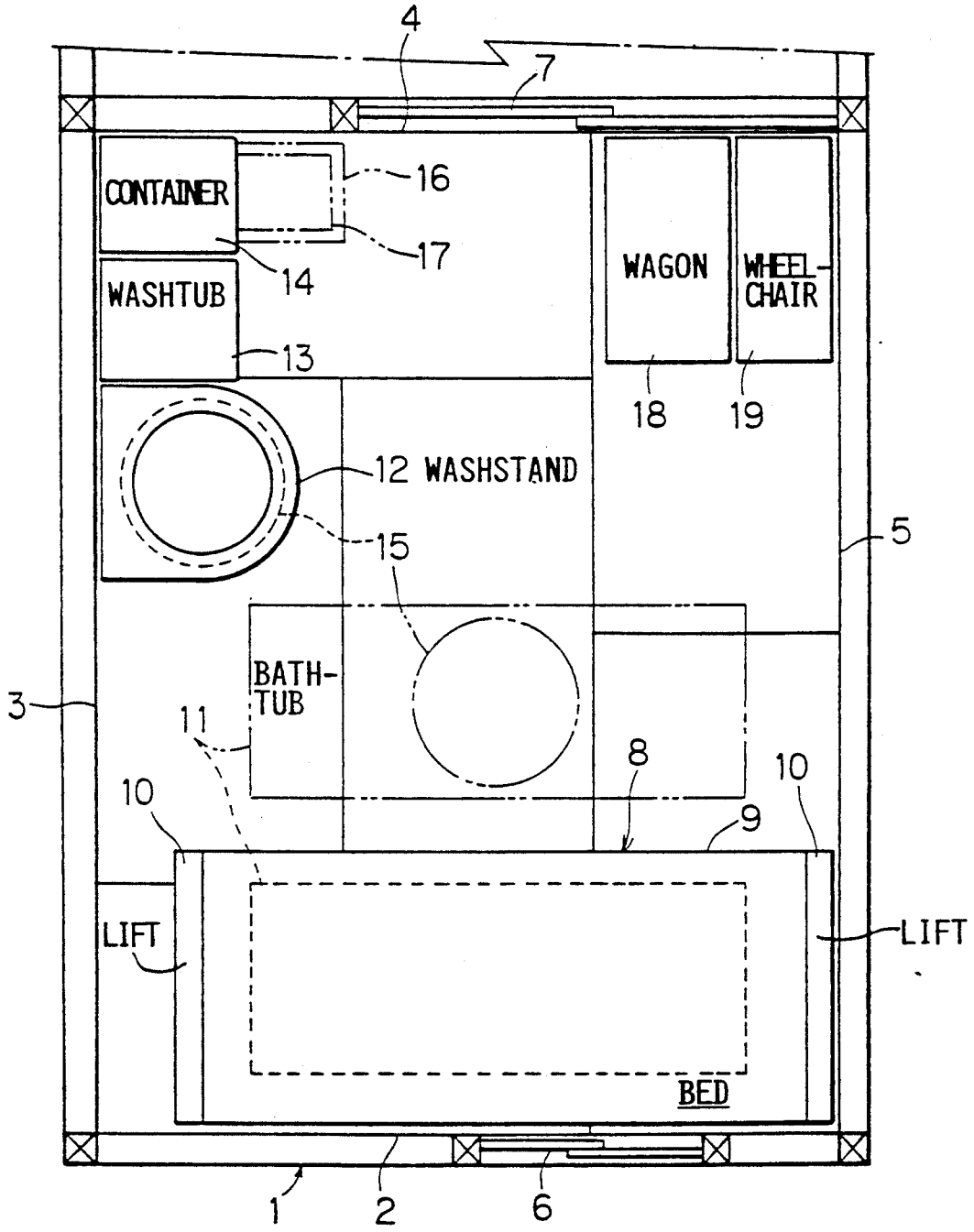
FIG. 1 is a plan view showing a room furnished with nursing equipment according to an embodiment of the present invention.

Referring to FIG. 1 a room 1 is furnished with nursing equipment according to an embodiment of the present invention.

The room 1 is in the form of a quadrangle having a 6-mat area size corresponding to about 270 cm by 360 cm. This quadrangle has a first wall 2, a second wall 3, a third wall 4 and a fourth wall 5. The first wall 2 is provided with a window 6, while the third wall 4, which is opposite to the first wall 2, is provided with a doorway 7.

A bed apparatus 8 is fixedly arranged in this room 1 along the first wall 2. This bed apparatus 8 comprises a bed body 9 for receiving an invalid thereon and a lift 10 for carrying the invalid between portions above and on one side of the bed body 9. The lift 10 is combined with an appropriate hanger member (not shown), for carrying the invalid in a desired state such as a lying or sitting state. In addition to the hanger member for carrying the invalid, the lift 10 can also be combined with utensils for rehabilitation. Thus, various utensils for rehabilitation may be provided in order to rehabilitate the invalid in various manners.

Such a bed apparatus 8 comprising the lift 10 is disclosed in my U.S. patent application No. 07/755,448, filed Sep. 5, 1991; now in condition for allowance, which is incorporated herein by reference.

A bathtub 11 is stored in a space under the bed body 9, as shown by broken lines. This bathtub 11 can be drawn out toward the one side portion of the bed body 9, as shown by two-dot chain lines.

The bathtub 11 can be stored in and drawn out from the space under the bed body 9 by a nurse, or through a mechanism which is disclosed in my U.S. patent application No. 07/788,205, filed Nov. 5, 1991, now in condition for allowance, which is also incorporated herein by reference.

The room 1 is further provided with a washstand 12, a washtub 13 and a container box 14 along the second wall 3, which is adjacent to the first wall 2. The washstand 12, the washtub 13 and the container box 14 may be arranged in any arbitrary order as space permits.

The washstand 12 is used by the invalid to wash his face and the washtub 13 is used for temporarily storing or washing the clothes etc. of the invalid, while the container box 14 is used for storing articles required for the daily life of the invalid or those required for nursing him.

A chamber pot 15 is stored in a space under the washstand 12, as shown by broken lines. This chamber pot 15 can be drawn out toward the side portion of the bed body 9, as shown by two-dot chain lines. The chamber pot 15, which is generally drawn out by the nurse, is preferably in the form of a stool.

A walking frame 16 is stored in a lower portion of the container box 14. This walking frame 16 can be drawn out in a state held in the container box 14, as shown by two-dot chain lines. The walking frame 16 comprises a circulative belt 17, for example, so that the invalid can step thereon.

The room 1 having a 6-mat area ensures a space which can allow ordinary actions of the invalid and the nurse, while leaving a space, such as the corner defined by the third and fourth walls 4 and 5, for example, which can receive other nursing equipment. According to this embodiment, a wagon 18 and a folded wheelchair 19 are arranged in this space.

The wagon 18, comprising a table, for example, can be moved closer to the bed body 9, for feeding the invalid. This wagon 18 can also be used as an auxiliary for the invalid who takes a walking exercise. Such a wagon comprising the aforementioned table, which can also be used as a walking auxiliary, is disclosed in Japanese Utility Model Laying-Open No. 64-42032 (1989) by the present inventor, for example. The wagon 18 may also comprise a container for small goods such as tableware.

The room 1 furnished with the nursing equipment set forth above can achieve the following various functions:

(1) Bathing

The bathtub 11 is drawn out toward the side portion of the bed body 9 as shown by the two-dot chain lines and filled up with hot water, to prepare for bathing. Then, the invalid who is laid on the bed body 9 is carried by the lift 10 in a lying or sitting state, and brought into the bathtub 11. After bathing, the invalid is brought back onto the bed body 9 by the lift 10, and the hot water is discharged so that the bathtub 11 is again stored in the space under the bed body 9 as shown by the broken lines.

(2) Defecation

The chamber pot 15 is located on the side portion of the bed body 9, as shown by the two-dot chain lines. Then, the invalid who is laid on the bed body 9 is brought onto the chamber pot 15 in a sitting state by the lift 10. After the invalid relieves himself, the lift 10 brings him back onto the bed body 9, while the chamber pot 15 is cleaned and again stored in the space under the washstand 12, as shown by the broken lines.

(3) Sleep

Similarly to an ordinary bed, the invalid can sleep on the bed body 9.

(4) Change of Sheet

The invalid who is laid on the bed body 9 is raised up by the lift 10 to define a clearance between the former and the latter, so that the sheet can be changed.

(5) Change of Pajamas etc.

The invalid is raised up from the bed body 9 similarly to the aforementioned case of the change of the sheet, so that pajamas or the like can be changed. If the bed apparatus 8 is hinged, the invalid may be brought into a sitting state on the basis of such a hinged mechanism, so that the pajamas or the like can be changed.

(6) Feeding

The invalid is brought into a sitting state on the bed body 9, so that he can take a meal. When the bed body 9 is provided on both sides with side guards, a table can be set across the side guards. The wagon 18 having a table can also be advantageously used for feeding the invalid. When the wagon 18 is provided with a container for small goods, tableware etc. can be drawn out from the container.

(7) Movement to Wheelchair

The wheelchair 19 is located by the nurse along the side portion of the bed body 9, so that the invalid who is laid on the bed body 9 can be carried toward and brought onto the wheelchair 19 in a sitting state by the lift 10.

(8) Face Washing

When the invalid is getting better, he can go to the washstand 12 with the help of the nurse or the wheelchair 19, to wash his face etc.

(9) Storage

The container box 14 can store articles which are necessary for the daily life of the invalid and those required for nursing him.

(10) Washing

The nurse can wash at least a part of the clothes etc. of the invalid in the washtub 13.

(11) Hand Exercise

The invalid can take hand exercise in a state lying on the bed body 9. The lift 10 may be provided with a pulley and a rope extending along the same so that the invalid can grasp end portions of the rope with his left and right hands, to alternately move his hands.

(12) Limb Exercise

Similarly to the case of the aforementioned hand exercise, the lift 10 may be provided with a pulley and a rope so that the invalid engages his foot with an end of the rope while grasping the other end with his hand and moves his hand to raise up the foot to exercise his limbs.

(13) Walking Exercise in a First Mode

The lift 10 provided on the bed apparatus 8 is used to form a bar for serving as a handrail for the invalid, who takes a walking exercise on the side portion of the bed body 9. The chamber pot 15, which can also serve as a stool, may be drawn out from the space under the washstand 12, so that the invalid can take a rest on the chamber pot 15 during the walking exercise.

(14) Walking Exercise in a Second Mode

The walking frame 16 may be drawn out from the container box 14, so that the invalid can take a walking exercise in another mode by stepping on the belt 17. Also in this case, the chamber pot 15 can be used as a stool. The container box 14 may be provided with a handle for the invalid.

(15) Walking Exercise in a Third Mode

The invalid can hold the wagon 18, which also serves as a walking auxiliary, to take walking exercise in still another mode. Also in this case, the chamber pot 15 can be used as a stool.

(16) Prevention of Bedsore/Medical Treatment

The invalid can be raised up from the bed body 9 by the lift 10 to define a clearance between the former and the latter similarly to the aforementioned case of the change of the sheet, thereby preventing him from getting a bedsore and facilitating the medical treatment. When a clearance is thus defined between the invalid and the bed body 9 for only several minutes a day, remarkable effects can be expected as to prevention of a bedsore as well as medical treatment.

Thus, according to this embodiment, it is possible to implement various functions within the room 1 having a dimension of 270 cm by 360 cm at the most.

Figure 2:
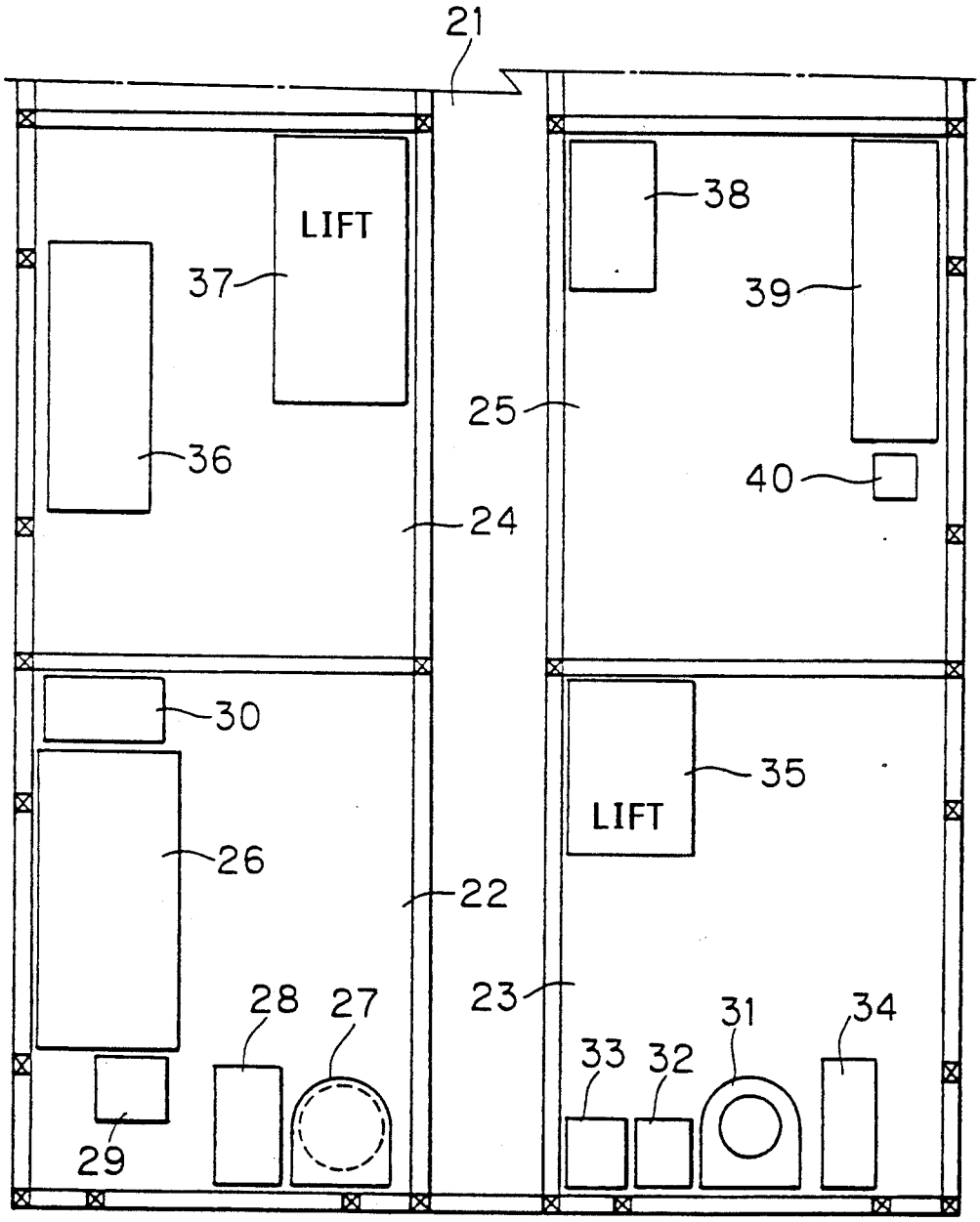
FIG. 2 PRIOR ART
FIG. 2 is a plan view showing a conventional example for comparing with the present invention.

FIG. 2 shows a comparative conventional example for comparing with the present invention. In the conventional example, equipment which are necessary for implementing the functions outlined above and made possible by the embodiment of the invention shown in FIG. 1 is arranged in ordinary states, to show the difference in the required spaces.

As shown in FIG. 2, four rooms 22, 23, 24 and 25 each having a size of 270 cm×360 cm are provided on both sides of a passageway 21. These rooms 22 to 25 must be provided with various equipment while providing spaces allowing ordinary actions.

The first room 22 is provided with a bed 26, a chamber pot 27, an ordinary wagon 28, a container 29 for small goods, and an ordinary walking auxiliary 30.

The second room 23 is provided with a washstand 31, a washtub 32, a container box 33, a folded wheelchair 34 and a movable lift 35 for lifting an invalid in a sitting state.

The third room 24 is provided with a bathtub 36 and a movable lift 37 for lifting the invalid in a lying state.

The fourth room 25 is provided with a walking frame 38 comprising a circulative belt so that the invalid steps thereon to take walking exercise, another walking frame 39 comprising bars for serving as handrails for the invalid who takes walking exercise, and a chair 40.

In order to implement the functions of the embodiment of the invention with this comparative example, the bathtub 36 and the lift 35 or 37 are required for (1) bathing;

the chamber pot 27 and the lift 35 are required for (2) defecation;

the bed 26 is required for (3) sleep;

the lift 37 is required for (4) change of sheet;

the lift 37 is required for (5) change of pajamas etc.;

the wagon 28 and the container 29 for small goods are required for (6) feeding;

the wheelchair 34 and the lift 35 are required for (7) movement to the wheelchair;

the washstand 31, the wheelchair 34 and the lift 35 are required for (8) face washing;

the container box 33 is required for (9) storage;

the washtub 32 is required for (10) washing;

the lift 35 or 37 is required for (11) hand exercise;

the lift 35 or 37 is required for (12) limb exercise;

the walking frame 39 and the chair 40 are required for (13) walking exercise in first mode;

the walking frame 38 is required for (14) walking exercise in second mode;

the walking frame 30 is required for (15) walking exercise in third mode; and the lift 37 is required for (16) prevention of bedsore/-medical treatment.

Without using the present invention, therefore, the four rooms 22 to 25 together have floor sizes four times as large as the single room in FIG. 1, in order to achieve the functions which are implemented by the embodiment of the invention. However, an ordinary house rarely has such four extra rooms 22 to 25. Even if such rooms 22 to 25 are provided in a house, in most instances it is impossible to assign all such rooms 22 to 25 to one invalid. Thus, it must be understood that the comparative example shown in FIG. 2 cannot be realized in practice in a normal private home.

According to the present invention, as hereinabove described, it is possible to satisfy all functions which are necessary for the daily life of an invalid, those required for nursing him, and those required for rehabilitating the invalid in a relatively narrow room having the above mentioned dimensions.

In particular, the bathtub is stored in the space which is defined under the bed body when the tub is not used. Since the space under the bed body is essentially dead space, it is possible to effectively utilize the narrow room by storing the bathtub in such a dead space.

The chamber pot is also stored in the dead space under the washstand when the pot is not used.

Further, the walking frame is stored in the container box when the frame is not used.

Thus, the bathtub, the chamber pot and the walking frame take up no extra space when the same are not used, whereby it is possible to effectively use the remaining space of the room so that the invalid and the nurse are not subjected to any inconvenience.

Since all equipment for nursing the invalid are provided in one small room, the distance for moving the invalid or for his action are short to reduce the burden on the invalid as well as that to which the nurse is exposed. Further, the lift provided on the bed apparatus need not be large.

Although the present invention has been described and illustrated in detail, it is clearly understood that the same is by way of illustration and example only and is not to be taken by way of limitation, the scope of the present invention being limited only by the terms of the appended claims.

What is claimed is:

1. A compact sick room and nursing equipment combination, comprising a quadrangular room having two long sides of 360 cm at the most and two short sides of 270 cm at the most providing a floor area of 270 cm by 360 cm at the most, a bed apparatus arranged along a first wall of said floor area, said bed apparatus having a bed body (9) for receiving an invalid thereon and a lift (10) for carrying said invalid between a first position above said bed body and a second position along one side of said bed body; a washstand, a washtub and a container box arranged along a second wall directly connected to said first wall of said floor area; a bathtub stored in a space under said bed body, said bathtub being drawable into a third position directly below said second position along said one side of said bed body; a chamber pot stored in a space under said washstand, said chamber pot being drawable out from under said washstand and to be brought into said third position when said bathtub is under said bed body; and a walking frame stored in a lower portion of said container box, said walking frame being drawable out of said container box in a state as held in said container box.

2. The compact sick room combination of claim 1, wherein said bed body is positioned alongside said first wall forming one of said short sides of said room.

3. The compact sick room combination of claim 2, further comprising a door in a second short wall forming the other short side of the room, whereby said door is arranged opposite to and in parallel to said bed body.

4. The compact sick room combination of claim 3, wherein said door is so positioned in said second short wall that one of said washstand, washtub, and container box fits into one corner next to said door, and so that at least a wheel chair fits into another corner next to said door.

5. The compact sick room combination of claim 1, wherein a sum total of a width of said bed body, of a width of said washstand, of a width of said washtub, plus a width of said container box and a width of said bathtub is less than said 360 cm, whereby said bed body, said bathtub, said washstand, said washtub, and said container are arranged in parallel to one another along one of said long sides of said sick room.

* * * * *